United States Patent [19]

Dabrowski et al.

[11] 3,996,719

[45] Dec. 14, 1976

[54] AUTOMATIC BAG STRAPPER

[75] Inventors: Wojciech M. Dabrowski, West Allis; Elwood B. Brown, Cedarburg, both of Wis.

[73] Assignee: Rexnord Inc., Milwaukee, Wis.

[22] Filed: Feb. 27, 1975

[21] Appl. No.: 553,721

[52] U.S. Cl. ..... 53/3; 53/198 R; 100/27

[51] Int. Cl.[2] ..... B65B 13/10

[58] Field of Search ..... 53/3, 198 R, 137; 100/26, 27, 28, 33 PB; 156/459, 468, 514; 270/80; 229/48 T

[56] References Cited

UNITED STATES PATENTS

| | | | |
|---|---|---|---|
| 2,995,080 | 8/1961 | Larsson | 100/27 |
| 3,033,728 | 5/1962 | Block et al. | 156/459 X |
| 3,126,686 | 3/1964 | Kobylanski et al. | 53/198 R |
| 3,331,312 | 7/1967 | Leslie et al. | 100/33 PB |
| 3,776,109 | 12/1973 | Clark et al. | 93/44 |
| 3,844,088 | 10/1974 | McDonough et al. | 53/3 |

*Primary Examiner*—Travis S. McGehee
*Assistant Examiner*—John Sipos
*Attorney, Agent, or Firm*—Sughrue, Rothwell, Mion, Zinn & Macpeak

[57] ABSTRACT

A method and apparatus are disclosed for applying a strap, which may have identifying indicia printed thereon, about an article, such as a piece of luggage, or other package. The article is placed within an opening defined by a closed loop support frame, and one end of the strapping material is engaged by a carrier pin attached to a chain which travels around the support frame. A loop is formed on the leading end of the tape surrounding the carrier pin, such that when the carrier pin is moved around the closed loop frame, and around the article, the tape is drawn from a supply reel and encircles the article. At the end of its circumferential trip around the article, the movement of the carrier pin is ceased, and the free, leading end of the strap is adhesively secured to a following portion of the strap so as to form a closed loop around the article. The strapping material is then severed, and movement of the luggage with respect to the support frame disengages the strap loop from the carrier pin and enables removal of the article from the apparatus.

12 Claims, 18 Drawing Figures

FIG. 1
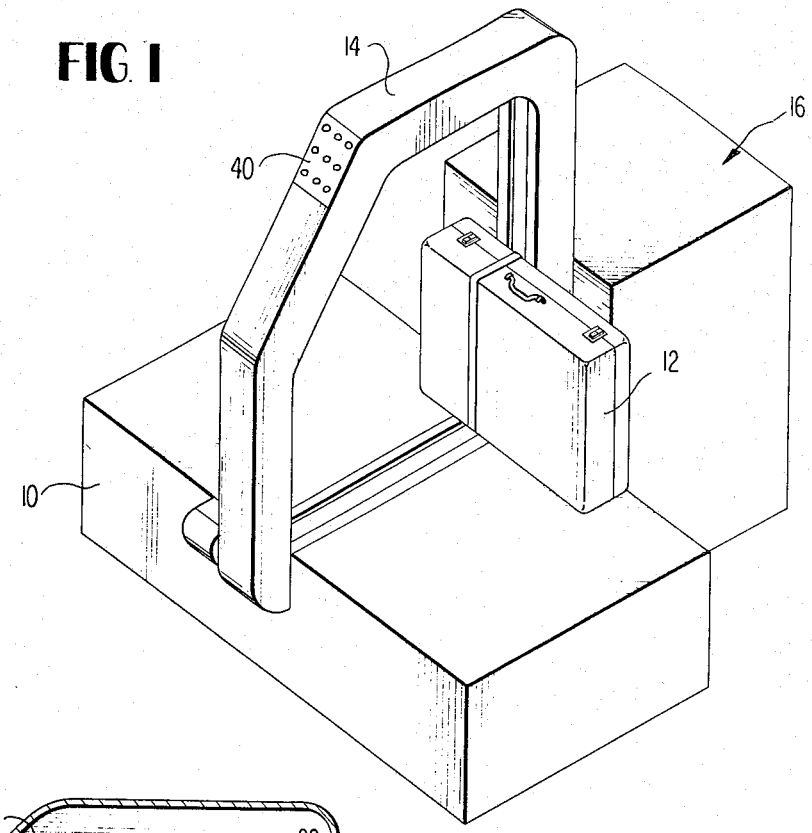
FIG. 2
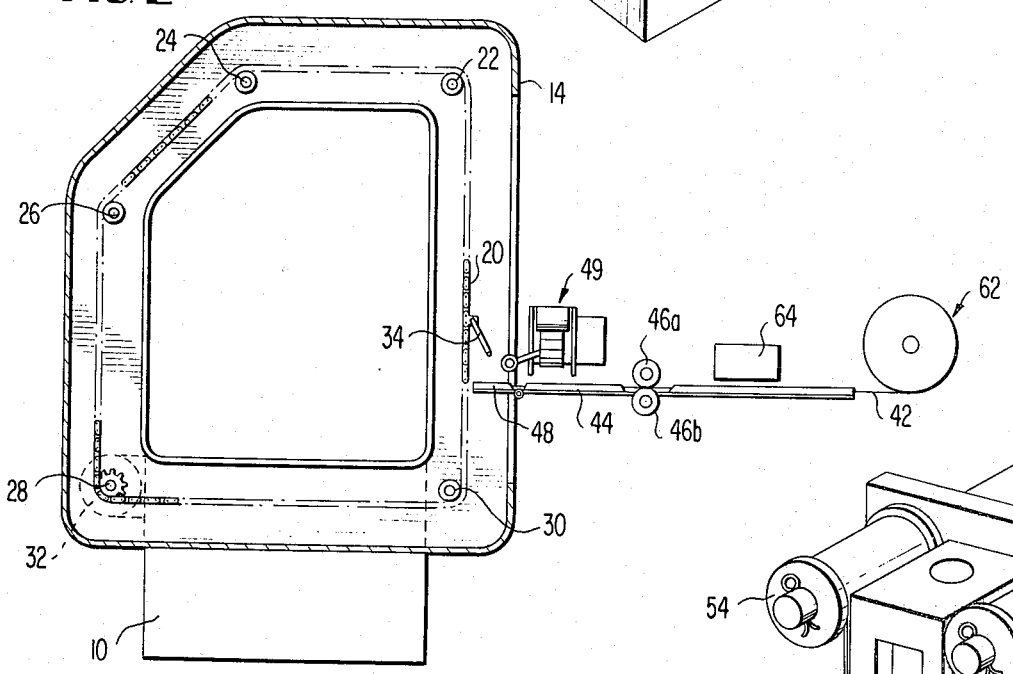
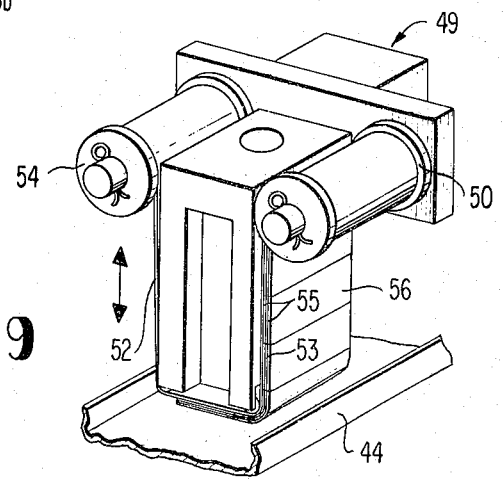
FIG. 9

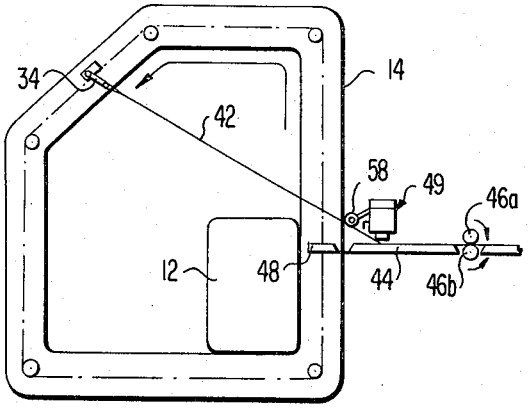
FIG. 10F
FIG. 10G
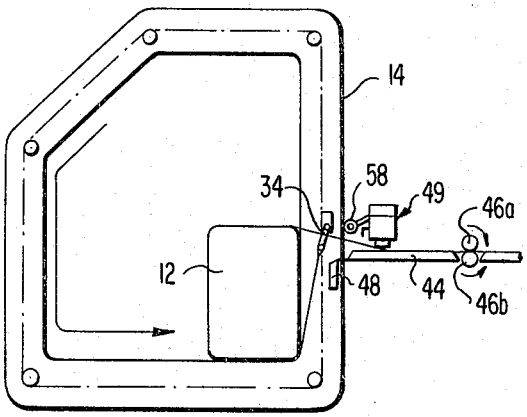
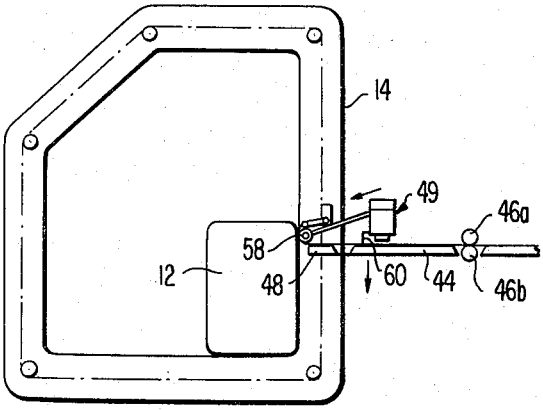
FIG. 10H
FIG. 10I
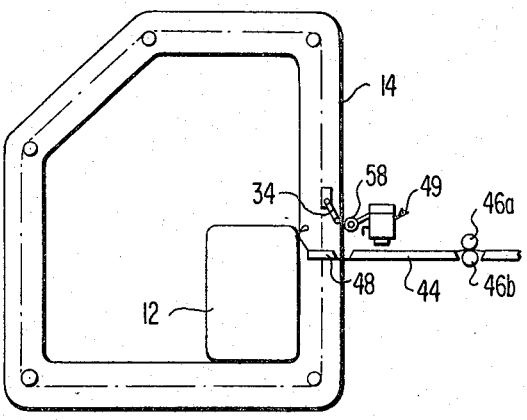

AUTOMATIC BAG STRAPPER

BACKGROUND OF THE INVENTION

1. Field of the invention

This invention relates generally to the field of applying a strapping material about an article. More specifically, it relates to a method and apparatus for applying a limp, flexible strapping material about various sized articles, wherein the strap may have identifying indicia printed thereon.

1. Description of the Prior Art

In general, devices for applying wire or metal straps around an article are well known. They usually consist of some means to cause the wire or metallic strapping material to traverse along a predetermined path around the article to be strapped and means to draw the strapping material tight around the article prior to crimping or otherwise fastening the ends of the strap together. However, such devices which are capable of applying a strap to a wide range of articles accomplish this by drawing excess strapping material from the source and the excess material must be subsequently drawn back or retracted to apply adequate tension to the strap around the article.

The step of drawing the strapping material tightly around the article is required since the strap is usually utilized to retain the article in an assembled position or attached to a device for shipping.

Attempts have also been made to attach identifying indicia to the articles by use of the strapping material. This usually takes the form of separate tags bearing the desired indicia and attached to the strapping material. The tags may be attached after the strap has been applied to the article or pre-assembled on the strapping material. Assembly of the indicia tags after the strapping has been applied is undesirable since it requires another operational step which increases handling time and costs. Pre-assembly of the identification tag is equally disadvantageous since it usually requires the fabrication of predetermined lengths of strapping material. This results in wastage of material when the strap is applied to an article of less than maximum size, again increasing handling costs.

The problem of attaching identifying indicia to a great many, various sized and shaped articles, in the minimum possible time, at minimum cost has assumed monumental proportions in the transportation industry. Airplanes, trains and buses usually all require the storage of baggage in a special compartment separated from the passenger area. This necessitates the use of baggage handling equipment which will attach identifying indicia to the baggage to assure that it is routed to the proper destination.

In the past, this has been accomplished by attaching tags to the handle of the baggage, or by attaching the tags to the baggage itself by means of straps encircling the baggage. In the former case, the tags are not readily readable in all of the bag orientations and are also easily separable from the bag. They are required to be manually atttached to the baggage, resulting in increased baggage handling time and increased cost. Also, the tags thusly attached are not capable of use with present day mechanical/optical machines which read the indicia and automatically route the baggage accordingly, thus also increasing the baggage handling time.

The system wherein the tags are attached to the baggage by straps encircling the bags also suffers from similar drawbacks. In most cases the straps are manually attached about the baggage, resulting in increased baggage handling time and inflated cost. Also, if a fixed length strap is utilized, it must obviously be designed for the largest practible bag and, therefore, results in much wasted material when utilized on a smaller size bag. The tags are usually not visually readable in all bag orientations, and may be separated from the strap during rough baggage handling operation, thus defeating their purpose. It is also known to utilize a heat shrinkable strap material having an indicia bearing tag attached thereto to indicate the proper baggage handling route. The strap is manually attached about the bag and subsequently passes through a heat applying operation so as to shrink the strap about the bag to prevent separation therefrom. This identification system not only suffers from the aforementioned drawbacks of high cost, since the heat shrinkable strap material is relatively expensive, but requires an extra handling step to apply heat to the baggage to cause the baggage to shrink. There is also the possibility of causing heat damage to the bag itself or its contents.

SUMMARY OF THE INVENTION

The present invention seeks to obviate the foregoing problems by providing a method and apparatus for attaching a limp, flexible strap about a wide size range of articles in a manner which will maintain the length of strap material drawn from the supply during the strapping operation to a length no greater than the circumference of any article being strapped. This feature permits the use of the strapping device disclosed herein with a device that applies to the strapping material identifying indicia unique to the article being strapped. Identifying indicia may be printed on the surface of the strap to provide means to readily identify the baggage regardless of its orientation. The strap may also have a printed code thereon which may be utilized in conjunction with mechanical/optical reading means to properly identify and route the baggage.

The apparatus for carrying out this strap applying method comprises a conveyor or support platform for supporting the article, a closed loop support frame defining an opening wherein the article is placed, a supply of limp, flexible strapping material, and means for printing the requisite indicia on the strapping material. The ground handling personnel place the article, typically a suitcase or the like, on the conveyor or support platform and in the opening defined by the closed loop frame. He then activates a control mechanism which automatically feeds an end of the flexible strapping material from the supply to a position adjacent the article.

If desired, the flexible strapping material may be fed through a printing device which automatically prints the correct identifying indicia on the surface. This information may be printed both in visually readable form and machine readable code form. After reaching its position adjacent the article, the free end of the strap is folded over a carrier pin which is attached to an endless chain. The endless chain in turn traverses around the closed loop support frame, completely encircling the article. The free end of the strap is retained in folded position by application thereto of an adhesive patch having adhesive on both sides. Once the loop has been formed about the carrier pin, the chain and carrier pin are caused to move around the support frame so as to draw the leading end strap material around the article.

Only the leading end of the strap is constrained to follow the path defined by the closed loop support structure. The following portion of the strap is free to swing from the carrier pin through the inside of the frame and wrap directly around the article. This enables the invention to eliminate the separate step of tightening the strap, required in the prior art devices, since the flexible strap is sufficiently tight after the leading end passes around the article. After passing around the baggage and passing its beginning point, the chain and carrier pin motion ceases. A roller engages the strapping material and presses the following portion of the strap material against the double sided adhesive patch on the leading end while a cutter cuts it from the strap supply. The double sided adhesive patch serves a dual function of retaining the two ends of the cut strap material together around the bag and of maintaining the leading end of the strap in a folded, looped position about the carrier pin. Once the tape has been cut, the bag is moved with respect to the support frame so as to disengage the attached strap loop from the carrier pin.

OBJECTS OF THE INVENTION

Thus, it is an object of the present invention to provide a method and apparatus for applying a limp, flexible strap about an article in such a way as to minimize operational time and cost. It is also envisioned that such strap may provide an indication if the article has tampered with while out of the owners possession.

It is a further object of the invention to print identifying indicia on the surface of the strap. This indicia may be in visually readable form or coded, machine-readable form or both.

It is also an object of this invention to provide an apparatus which will apply a flexible strap about a large variety of sizes and shapes of articles while minimizing wastage of strapping material.

BRIEF DESCRIPTION OF THE DRAWINGS

In the drawings:

FIG. 1 is a perspective view of strapping apparatus according to the present invention;

FIG. 2 is a detailed view of the strap applying mechanism of the present invention;

FIG. 9 is a detailed view of the adhesive patch application mechanism used in conjunction with the present invention; and FIGS. 10A through 10I show the sequence of operation of a strapping machine according to the present invention.

DETAILED DESCRIPTION OF THE PREFERRED EMBODIMENT

Figure 3:
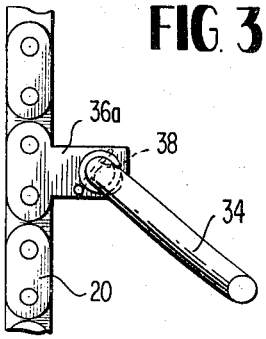
FIGS. 3 and 4 are detailed views of the carrier pin and its attachment to the carrier chain.

The article strapping apparatus according to the present invention is shown in FIG. 1. It includes a conveyor or support platform 10 for supporting the article 12, a closed loop support frame 14 defining an opening into which the article is placed and located adjacent to the source of strapping material, and means to supply a flexible strapping material and to print the required indicia thereon, shown generally at 16.

The closed loop support frame 14 has a generally U-shaped cross-section, with the open portion of the "U" facing inwardly toward the opening. Located within this cross-section is a chain 20 guided around the frame 14 by sprockets 22, 24, 26, 28 and 30. Sprocket 28 is connected to an electric motor 32 to provide to motive force for driving the chain. A gear box (not shown) may be interposed between the sprocket 28 and motor 32 if desired. The motor or motor and gear box may be of any type which will move the chain 20 in both a clockwise and counterclockwise direction.

Figure 4:
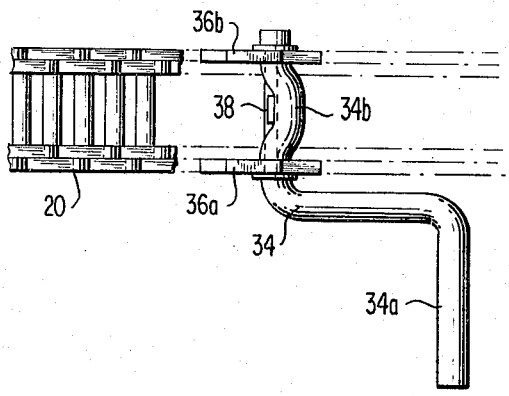
Figure 5:
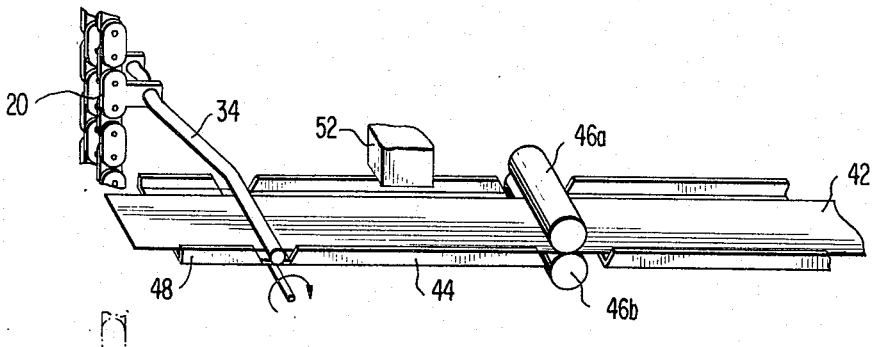
FIGS. 5 through 8 show the sequence of operation of the loop forming mechanism used to attach the strapping material to the carrier pin in the present invention.
Figure 6:
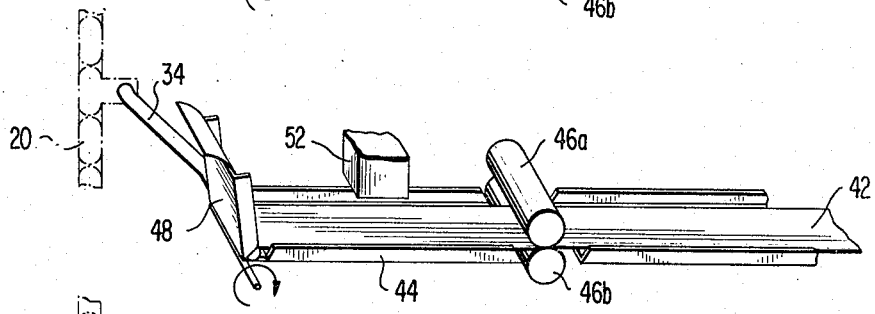
Figure 7:
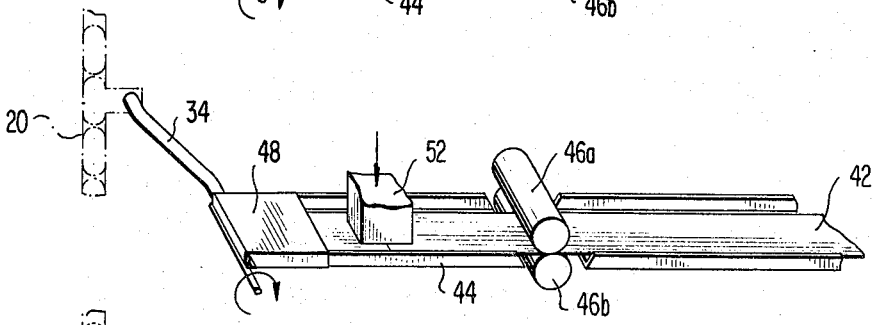
Figure 8:
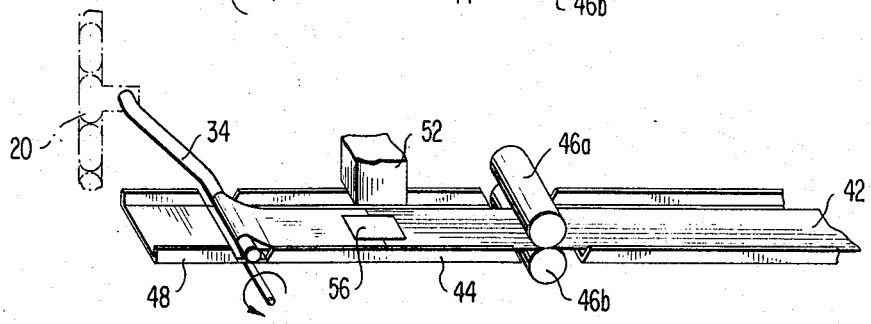

Carrier pin 34 is pivotally attached to the chain 20 by brackets 36*a* and 36*b* as shown in FIGS. 3 and 4. The carrier pin has a distal end 34*a* which is oriented in a direction generally perpendicular to the direction of travel of the chain 20. Leaf spring 38 acts on the crank portion 34*b* of carrier pin 34 in order to bias the carrier pin in a position such that the distal end 34*a* is normally away from the chain a predetermined distance. Actuation of the motor 32 and the determination of the direction of movement of the chain 20 are accomplished by manual actuation of various keys on key board 40 located on the support frame 14.

The strapping supply 62 system comprises generally a supply of limp, flexible strapping material 42, means to feed the leading end of the strapping material from the supply to a position adjacent the article 12, and means to loop the leading end of the tape around the carrier pin 34. The flexible strap may be of a polyethylene material or any other material having the requisite flexibility and strength. The strapping may also pass from the strapping supply into a printing device 64 which automatically feeds the leading end to its position adjacent the article and prints thereon both visual indicia and indicia in coded form for use with a mechanical/optical reading device. The printing device may also be controlled automatically by way of the key board 40 attached to the support frame 14. Any printing device having the capabilities of printing both coded and visually readable indicia on a flexible strapping material may be utilized with the invention. The specific structure of the printing device, per se, forms no part of this invention.

After passing through the strapping feed device or, if utilized, the printing device, the leading end of the strapping material 42 passes along feed tray 44, between the tension rollers 46*a* and 46*b*, and onto pivotable flap 48. The feed tray 44 may have upturned sides so as to provide a lateral guide for the strapping material 42. Flap 48 is pivotable about an edge located adjacent to the end of feed tray 44, and forms a part of the means to form a loop in the leading end of the strapping material. As shown in FIGS. 5 through 8, after the leading end of the strapping material 42 passes over the flap 48, the feeding of the strapping material is stopped, and the means to rotate flap 48 is actuated. As this flap is rotated, the end of the strapping material 42 is folded over the carrier pin portion 34*a* and fixed to a following portion of the strapping material. This then forms a loop which fastens the strapping material to the carrier pin 34 and enables the leading end of the material to be pulled circumferentially around the article by the movement of chain 20 and carrier pin 34.

A typical apparatus for attaching the leading end portion of the strapping material 42 to a following portion to form the aforementioned loop around carrier pin 34 is shown generally at 49 in FIG. 9. In the preferred embodiment of the invention, the leading end of the strapping material is fixed to the following portion by application of a patch having adhesive on both sides. The patch is automatically applied to the strapping material by the apparatus 49 of FIG. 9. The adhesive patches 56 are carried on a carrier strip, which may be a thin paper having a waxy surface, and are originally wound on supply reel 50. The carrier strip passes downwardly from the supply reel 50, around the bottom of platen 52, and onto take-up reel 54. The reels 50 and 54 are rotated to successively locate a single adhesive patch 56 on the bottom of platen 52. Platen 52 is located above the strapping material and, after flap 48 has folded the leading end back onto the following portion, platen 52 is lowered to bring adhesive patch 56 into contact with the junction of the leading end and the following portion of the material to affix them together. Since the adhesive has greater affinity for the strapping material than its carrier strip, the adhesive patch remains on the strapping material after the platen 52 is withdrawn. Although the adhesive patch applying device described above has been found to perform satisfactively with the invention, obviously any means to apply the patch to the strapping material may be utilized.

The remaining apparatus will be described in conjunction with a description of the operational sequence of the invention, shown generally in FIGS. 10A through 10I.

The article is first placed in the opening defined by the support frame 14 and on the conveyor or support platform 10. This may be accomplished either manually or by a mechanical conveyor device. The article is placed adjacent the side of the support frame adjacent the strap supply and printing system as shown in FIG. 10B.

Figure 10A:
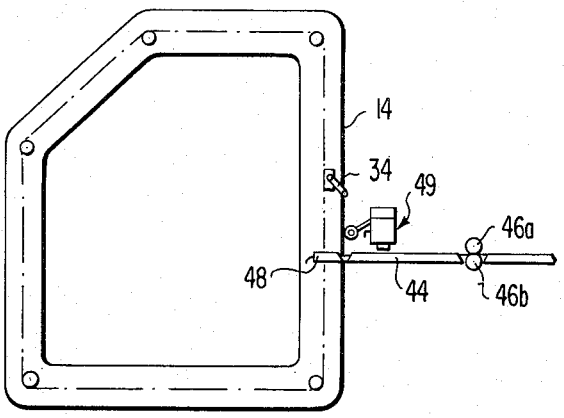

Before operation of the invention is started, carrier pin 34 is located above flap 48 and feed 44 as shown in FIG. 10A. Once the article is in position, the operator actuates the strapping mechanism by pressing the appropriate keys on the key board 40. The feeding device feeds the strapping material from the supply, along the feed tray 44, through tension rollers **46*a* and 46*b*, and onto flap 48.**

If a printing device is utilized, it may serve a dual function of feeding the strapping material from the supply and printing the desired indicia on the strapping surface. The printing device is also actuated automatically to print the correct indicia corresponding to the input of the operator.

Figure 10B:
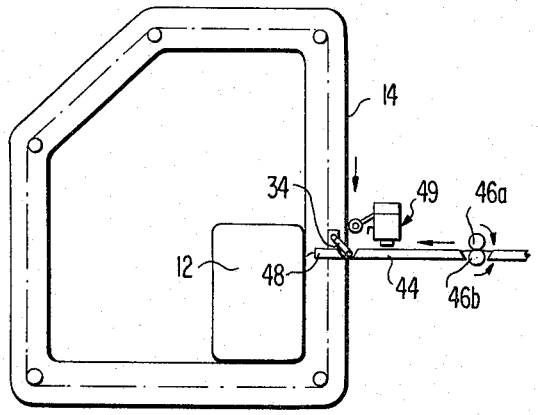
Figure 10C:
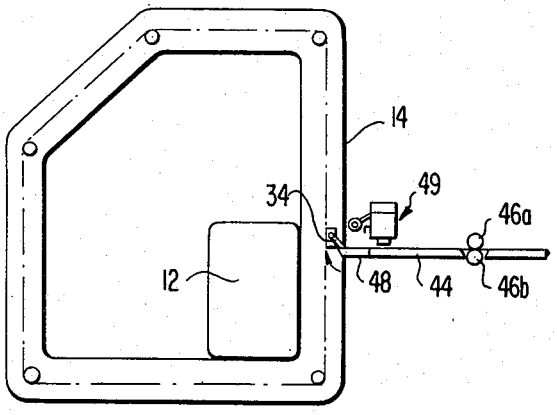
Figure 10D:
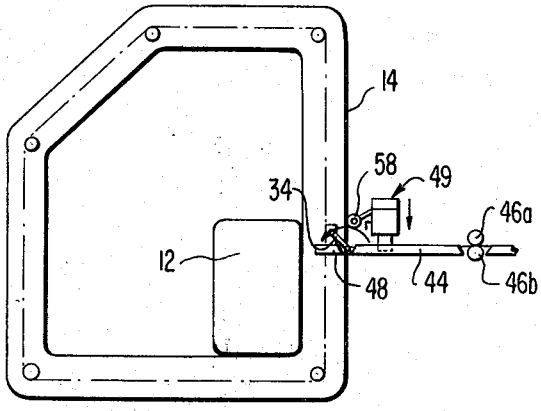
Figure 10E:
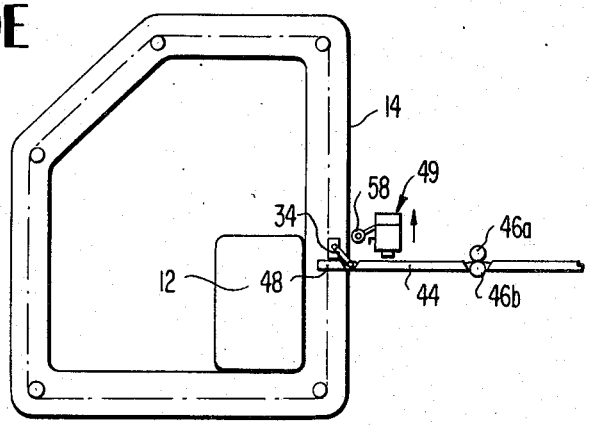

As the leading end of the strapping material approaches the edge of flap 48, the carrier chain 20 moves in a clockwise direction, as shown in FIG. 10B, until the carrier pin 34 contacts the strapping material. The carrier chain 20 then ceases further movement, and the loop forming mechanism is actuated. Flap 48 is then pivoted about its edge so as to fold the leading end of the strap material over the carrier pin 34 and back onto a following portion of the material so as to form a loop around carrier pin 34. The leading end is retained in this position by application of an adhesive patch by the mechanism 49 shown in FIG. 9 and previously described.

Prior to retraction of the patch applicator platen 52, the flap 48 is returned to its original position. After the retraction of platen 52, the chain drive motor 32 is again actuated to move the chain 20 and carrier pin 34 in a counterclockwise direction. This pulls the strapping material 42 around the article 12 as shown in FIGS. 10E–10H. Only the leading end of the strapping material attached to carrier pin 34 is constrained to follow the circumferential path defined by the support frame 14 and, since it may pivot with respect to the carrier pin 34, the remainder of the strapping material may be wound directly around the article, as shown in FIGS. 10F and 10G.

Within a wide range of article sizes, at no time in the strapping cycle is the length of strapping material 42 withdrawn greater than the circumference of the article 12 being strapped. The lower limit of article sizes which can be strapped without obtaining an excess of strapping material can be lowered by providing that the carrier pin 34 traverses a path which is diagonally cut off at the corner remote from the feeding device, thereby causing the carrier pin 34 to follow a path which roughly describes an arc around the feeding device. This is especially important when using strapping material having printed indicia thereon which indicia is unique to the article being strapped, because, with the present invention, there is no resulting excess of such material which would have to be retracted to provide proper tension and then wasted since the subsequently strapped article would require its own unique printed indicia.

As the carrier pin 34 approaches the side of the article from which the strapping operation began, after passing beneath the article, the carrier pin is disposed rearwardly respecting the direction of chain travel and inwardly respecting the support frame due to the tension on the strapping material as best shown in FIG. 10G. This position of the pin allows it to pass by the end of the flap 48 without contact therewith. Proper tension in the strapping material is maintained by tension rollers **46*a* and 46*b*** throughout the operation of the device.

The tension rollers **46*a* and 46*b*** also may function as the feeding device for feeding the strapping material from the supply if the aforementioned printing/feeding device is not utilized.

As the carrier pin 34 passes by its original starting position, the chain 20 is stopped, and seal roller 58 engages the upper surface of the following portion of the strapping material as shown in FIG. 10H and pushes it toward the article so as to contact the second side of the adhesive patch disposed on the leading end of the strapping material. This seals the strap around the article, and the cutting mechanism 60 severs the sealed strap from the remaining strap supply. After the ends of the strap have been adhesively sealed, the sealing roller 58 is retracted and the article is ready for removal from the strapping machine. The article is removed by moving it generally perpendicular to the plane of the closed loop support frame 14, so as to disengage the loop formed in the leading end of the strap material from the carrier pin 34. This movement may be accomplished either manually or by activation of a mechanical conveyor device. Upon removal of the baggage, the carrier pin 34 rotates counterclockwise back to its original positon due to the action of the leaf spring 38 acting on crank portion **34*b*,** and it is ready for another strapping operation.

In its preferred embodiment, the adhesive patch 56 is made so as not to be resealable after separation of the initial seal. Referring to FIG. 9, such a patch may be provided by interposing between the opposite adhesive faces 55 of the patch 56 a non-adhesive backing strip 53 of material with a lower tensile strength than the adhesive joints formed between the adhesive faces 55 and the surfaces of the strap. Removal of the strap will separate the backing strip 53 leaving a portion thereof adhering to each of the adhesive faces. The strap cannot thereafter be resealed, thus providing a means of determining if unauthorized removal of the strap has occurred.

It is envisioned that any type of automatic control system may be utilized to actuate the apparatus in the sequence previously described. Typically, this may take the form of electric motors for driving the chain 20, rotating the flap 48, actuating the patch application mechanism 49, rotating the feed or tension rollers 46*a* and 46*b*, moving the seal roller 58, and operating the cutting mechanism 60. The sequential operation may be controlled by the actuation of standard limit switches engaged by various parts of the invention during their movement, such as carrier pin 34, tape 42, flap 48, or patch applicator 49. These switches and their function are well known in the art, and no detailed description is believed to be necessary in order to make and use the present invention.

Obviously any devices which sense physical movement and generate a control signal in response thereto may be utilized. Similarily, other means for moving the chain 20, the flap 48, the seal roller 58, the patch applicator 49, and the cutter 60 may also be utilized as long as such means are capable of control to operate in the aforementioned sequence.

What is claimed is:

1. Apparatus for applying a strap about an article, such as baggage, package, etc., comprising:

a. first means for supplying a limp, flexible strapping material;

b. a movable carrier;

c. second means for feeding said flexible strapping material from said first means to said carrier;

d. third means for removably attaching a leading end of the strapping material only to said carrier in a fashion permitting it to pivot about said carrier, said third means comprising:

i. guide means for guiding the said strapping material from said second means to said carrier;

ii. fourth means for folding the leading end of the strapping material back over itself and over a portion of said carrier so as to form a loop removably engaging a portion of said carrier; and iii. fifth means for applying an adhesive patch to the strapping material to retain the leading end in the loop;

e. sixth means for moving said carrier along a path completely around the periphery of an article, during which movement the strapping material pivots with respect to said carrier, allowing the remainder of the strapping material to be wound directly around the article;

f. seventh means engaging the strapping material to provide a tension in the strapping material as said carrier traverses its path around the articles, whereby the amount of material drawn out of said first means is limited to a length no greater than the circumference of the article being strapped with a wide range of article sizes without requiring retraction of the excess material;

g. eighth means for attaching the leading end of the strapping material to a following portion of the strapping material so as to form a closed loop around the article; and h. ninth means for severing the closed loop portion of the strapping material from said first means to enable removal of the strapped article from the apparatus.

2. The strapping apparatus of claim 1 wherein said sixth means comprises:

a. a closed loop support frame defining an opening into which is placed the article to be strapped;

b. endless conveying means attached to said support frame so as to be movable along a path defined by the closed loop;

c. means to move said endless conveying along said path; and d. means to attach said carrier to said endless conveying means.

3. The strapping apparatus of claim 2 wherein said carrier and said means to attach said carrier to said endless conveying means comprise:

a. at least one bracket attached to said endless conveying means:

b. a carrier pin having a first end pivotally attached to said bracket and a second end generally parallel to said first end, but offset therefrom; and c. spring means attached to said at least one bracket and engaging said carrier pin so as to bias said carrier pin in a predetermined orientation with respect to said endless conveying means.

4. The strapping apparatus of claim 2 wherein said endless conveying means is a chain.

5. The strapping apparatus of claim 2 wherein said endless conveying means is a belt.

6. The strapping apparatus of claim 2 wherein said closed loop support frame has a generally U shaped cross section the open portion of which faces inwardly toward the opening and said endless conveying means is disposed between the legs of the U shape.

7. The strapping apparatus of claim 1 wherein said second means also prints indicia on the surface of the strapping material

8. The strapping apparatus of claim 1 wherein said fourth means comprises:

a. a flap rotatable about one edge adjacent to an end of said guide means, said flap normally being coplanar with said guide means, and b. means for rotating said flap about said one edge after the leading end of the strapping material has been placed thereon, thereby folding said leading end over said carrier and forming a loop in the strapping material.

9. The strapping apparatus of claim 1 wherein said adhesive patch has adhesive on both sides, one side serving to retain the leading end of the strapping material in a loop and the other side serving to attach the leading end to the following portion after the leading end has traveled around the article to be strapped.

10. The strapping apparatus of claim 9 wherein the adhesive on both sides of said adhesive patch has interposed therebetween a backing strip comprising a non-adhesive material having a lower tensile strength that the adhesive bond formed between the adhesive sides and the strapping material.

11. The strapping apparatus of claim 6 wherein said endless conveying means traverses a path which is diagonally cut off at the corner remote from said second means, thereby causing said carrier to follow a path which roughly describes an arc around said second means and lowering the limit of article sizes which can be strapped without obtaining an excess of strapping material.

12. A method for applying a strap about an article, such as baggage, packages, etc., comprising the steps of:

a. feeding a leading end of a limp, flexible strapping material from a material supply to a position adjacent the article to be strapped;

b. placing the leading end of the strapping material adjacent a portion of the movable carrier;

c. folding the leading end back over the portion of the movable carrier so as to form a loop therearound;

d. fastening said folded leading end to a following portion of the strapping material to removably retain the end in a loop;

e. moving the carrier and the leading end of the strapping material completely around the article such that the strapping material completely encircles said article during which movement the strapping material pivots with respect to the carrier, allowing the remainder of the strapping material to be wound directly around the article;

f. providing a tension in the strapping material as the carrier traverses its path around the article, thereby limiting the amount of material drawn out of the material supply to a length no greater than the circumference of the article being strapped within a wide range of article sizes without requiring retraction of the excess material;

g. attaching the leading end of the strapping material to a following portion of the strapping material so as to retain the strap about the article;

h. severing the strapping material between the strap formed about the article and the strapping material supply; and i. removing the strapping material leading end from the movable carrier.

* * * * *